US011375782B2

(12) United States Patent
Yang et al.

(10) Patent No.: US 11,375,782 B2
(45) Date of Patent: Jul. 5, 2022

(54) OUTDOOR UMBRELLA FRAME HAVING TELESCOPIC STRUCTURE

(71) Applicant: ZHEJIANG YOTRIO GROUP CO., LTD, Zhejiang (CN)

(72) Inventors: Yi Yang, Zhejiang (CN); Tongguo Wang, Zhejiang (CN); Jianqiang Xie, Zhejiang (CN)

(73) Assignee: ZHEJIANG YOTRIO GROUP CO., LTD, Zhejiang (CN)

( * ) Notice: Subject to any disclaimer, the term of this patent is extended or adjusted under 35 U.S.C. 154(b) by 0 days.

(21) Appl. No.: 17/135,914

(22) Filed: Dec. 28, 2020

(65) Prior Publication Data

US 2021/0112933 A1 Apr. 22, 2021

(30) Foreign Application Priority Data

Oct. 28, 2020 (CN) ..... 202022440483.0

(51) Int. Cl.

| | |
|---|---|
| ***A45B 19/04*** | (2006.01) |
| ***A45B 19/06*** | (2006.01) |
| ***A45B 23/00*** | (2006.01) |
| *A45B 19/12* | (2006.01) |
| *A45B 11/00* | (2006.01) |

(52) U.S. Cl.

CPC ..... *A45B 19/04* (2013.01); *A45B 19/06* (2013.01); *A45B 19/12* (2013.01); *A45B 2011/005* (2013.01); *A45B 2023/0012* (2013.01); *A45B 2023/0037* (2013.01); *A45B 2023/0062* (2013.01)

(58) Field of Classification Search

CPC .... A45B 2023/0031; A45B 2023/0037; A45B 2023/0062

See application file for complete search history.

(56) References Cited

U.S. PATENT DOCUMENTS 1,205,809 A * 11/1916 Steele ..... A45B 19/06 135/26
1,587,475 A * 6/1926 Davis ..... A45B 19/06 135/26

(Continued)

FOREIGN PATENT DOCUMENTS

CN 201839926 5/2011
EP 2614746 A1 * 7/2013 ..... A45B 25/02

*Primary Examiner* — David R Dunn
*Assistant Examiner* — Danielle Jackson
(74) *Attorney, Agent, or Firm* — JCIP Global Inc.

(57) ABSTRACT

An outdoor umbrella frame has a telescopic structure, and includes an umbrella pole, a pull rod assembly and a rib assembly. The pull rod assembly includes a first pull rod and a second pull rod. The rib assembly includes a longer rib and a shorter rib, the umbrella pole may be telescopic along a length direction, and one or more of the first pull rod, the second pull rod, the longer rib and the shorter rib may be telescopic along a length direction. When the outdoor umbrella frame is assembled, the umbrella pole, the first pull rod, the second pull rod, the longer rib and the shorter rib are all in an extended and fixed state. When the outdoor umbrella frame is disassembled for packing, any one or more of the umbrella pole, the first pull rod, the second pull rod, the longer rib and the shorter rib are in a retracted state.

11 Claims, 9 Drawing Sheets

(56) References Cited

U.S. PATENT DOCUMENTS

| | | | | |
|---|---|---|---|---|
| 5,678,585 | A * | 10/1997 | May | A45B 23/00 135/20.1 |
| 5,960,806 | A * | 10/1999 | Steiner | A45B 23/00 135/20.1 |
| 6,478,037 | B2 * | 11/2002 | Tung | A45B 23/00 135/20.1 |
| 7,156,114 | B2 * | 1/2007 | Lo | A45B 23/00 135/20.1 |
| 7,814,920 | B2 * | 10/2010 | Lenahan | A45B 11/00 135/20.1 |
| 7,886,755 | B2 * | 2/2011 | Tung | A45B 23/00 135/21 |
| 9,528,313 | B1 * | 12/2016 | Arimilli | A45B 17/00 |
| 11,033,085 | B1 * | 6/2021 | Chen | A45B 19/06 |
| 11,122,872 | B2 * | 9/2021 | He | A45B 25/14 |
| 2003/0070700 | A1 * | 4/2003 | Tung | A45B 19/06 135/26 |
| 2011/0057077 | A1 * | 3/2011 | Johnson | A45B 3/00 248/124.2 |

* cited by examiner

OUTDOOR UMBRELLA FRAME HAVING TELESCOPIC STRUCTURE

CROSS-REFERENCE TO RELATED APPLICATION

This application claims the priority benefit of China application serial no. 202022440483.0, filed on Oct. 28, 2020. The entirety of the above-mentioned patent application is hereby incorporated by reference herein and made a part of this specification.

BACKGROUND

Technical Field

The disclosure relates to the technical field of outdoor umbrellas, and in particular to, an outdoor umbrella frame having a telescopic structure.

Description of Related Art

As an outdoor leisure tool, the outdoor umbrella is also called the sunshade, parasol, Roman umbrella, central pole umbrella, banana umbrella, etc. It is widely applied to the square, sandbeach, garden, courtyard and other leisure venues and offers a comfortable leisure and cool space for people. Structurally, the outdoor umbrella often includes a base, an umbrella pole, an umbrella fabric, an umbrella tray and a rib; the umbrella pole is vertically disposed and serves as a support pole of the umbrella; the umbrella fabric generally covers the rib; and the extension or retraction of the whole umbrella is implemented through the rib.

However, the existing outdoor umbrella has a large size to result in that the whole outer package is large, the transportation is inconvenient and the logistics cost is high. In view of this, the applicant has developed a detachable sunshade hanging umbrella with the publication number of CN 201839926 U. The umbrella includes a fixed vertical pole, an umbrella frame, and a central pole connected to the umbrella frame; the central rod includes an upper portion connected to the umbrella frame and a lower portion connected to the vertical pole. The vertical pole includes a plurality of detachably assembled branch poles and a plurality of connecting structures for connecting adjacent branch poles. With the detachably assembled branch poles forming the structure of the vertical pole, the packing size of the sunshade hanging umbrella may be reduced in transportation to lower the transportation cost. The sunshade hanging umbrella may also be packed when not used for easy storage. Nevertheless, only with the vertical pole as the detachable structure, the effect for reducing the size is limitable. Even though some design uses the foldable structure to reduce the size of the rib and other components, there is still the space needed for the size of each component and the size cannot be reduced greatly.

SUMMARY

An objective of the disclosure is to provide an outdoor umbrella frame having a telescopic structure, to solve the above technical problems. Each component of the outdoor umbrella frame may be detachable and telescopic, and each component may be superimposed in size, such that the packing size may be greatly reduced.

The disclosure may use the following technical solutions to solve the technical problems.

An outdoor umbrella frame having a telescopic structure includes an umbrella pole, a pull rod assembly and a rib assembly. The pull rod assembly includes a first pull rod and a second pull rod. The rib assembly includes a longer rib and a shorter rib. The umbrella pole may be telescopic along a length direction, and one or more of the first pull rod, the second pull rod, the longer rib and the shorter rib may be telescopic along a length direction. When the outdoor umbrella frame needs to be assembled, the umbrella pole, the first pull rod, the second pull rod, the longer rib and the shorter rib are all in an extended and fixed state. When the outdoor umbrella frame needs to be disassembled for packing, any one or more of the umbrella pole, the first pull rod, the second pull rod, the longer rib and the shorter rib are in a retracted state.

The umbrella pole includes at least two telescopic structures, and any one or more of the first pull rod, the second pull rod, the longer rib and the shorter rib includes at least two telescopic structures.

When any one of the umbrella pole, the first pull rod, the second pull rod, the longer rib and the shorter rib is extendable or retractable along the length direction, extension or retraction locking may be implemented by a locking mechanism.

The locking mechanism includes any one of a lockpin locking mechanism, a spring ball locking mechanism, a screwed locking mechanism or a handle rubbed locking mechanism.

The umbrella pole includes an umbrella pole body and a telescopic umbrella pole, the telescopic umbrella pole is located on an upper portion or/and a lower portion of the umbrella pole body, and the telescopic umbrella pole and the umbrella pole body are in telescopic fit.

The first pull rod includes a first pull rod body and a first telescopic pull rod, one end of the first telescopic pull rod is hinged to the telescopic umbrella pole, the other end of the first telescopic pull rod is telescopically docked with one end of the first pull rod body, and the other end of the first pull rod body is hinged to the second pull rod.

The second pull rod includes a second pull rod body and a second telescopic pull rod, one end of the second telescopic pull rod is hinged to an upper umbrella tray, the other end of the second telescopic pull rod is telescopically docked with one end of the second pull rod body, and the other end of the second pull rod body is hinged to a handle housing.

The longer rib includes a longer rib body and a longer telescopic rib, one end of the longer telescopic rib is hinged to the upper umbrella tray, and the other end of the longer telescopic rib is telescopically docked with the longer rib body.

The shorter rib includes a shorter rib body and a shorter telescopic rib, one end of the shorter telescopic rib is hinged to a lower umbrella tray, the other end of the shorter telescopic rib is telescopically docked with one end of the shorter rib body, and the other end of the shorter rib body is hinged to the longer rib.

The telescopic umbrella pole includes at least one telescopic umbrella pole unit. The first telescopic pull rod includes at least one first telescopic pull rod unit. The second telescopic pull rod includes at least one second telescopic pull rod unit. The longer telescopic rib includes at least one longer telescopic rib unit, and the shorter telescopic rib includes at least one shorter telescopic rib unit.

Compared with the prior art, the disclosure has the following prominent advantages and effects. By means of an optimized design and with the utilization of telescopic and superimposed structures, the disclosure may implement the superimposition in size among the umbrella pole, the pull rod assembly and the rib assembly, thereby greatly reducing the overall size, reducing the packing size, and lowering the transportation cost.

Features of the disclosure may be clearly known with reference to the accompanying drawings and the following detailed description on good implementation manners.

DESCRIPTION OF THE EMBODIMENTS

Figure 1:
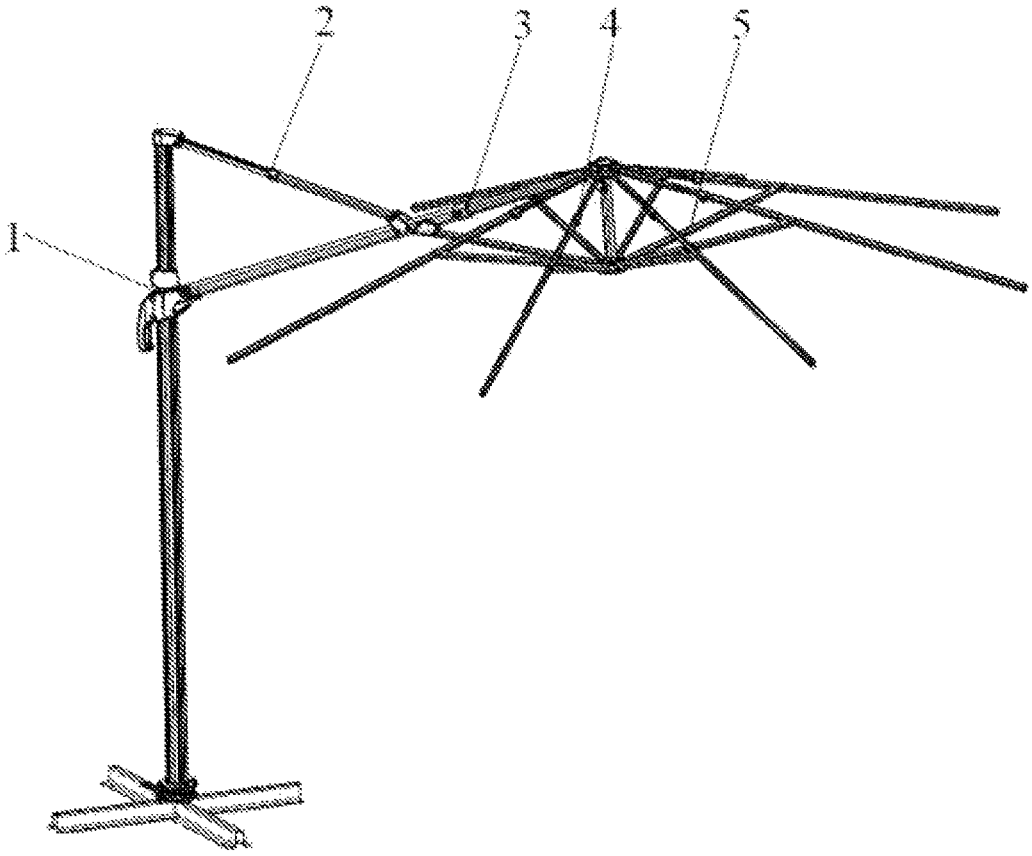
FIG. 1 is a structural schematic diagram of overall mounting according to the disclosure.
Figure 2:
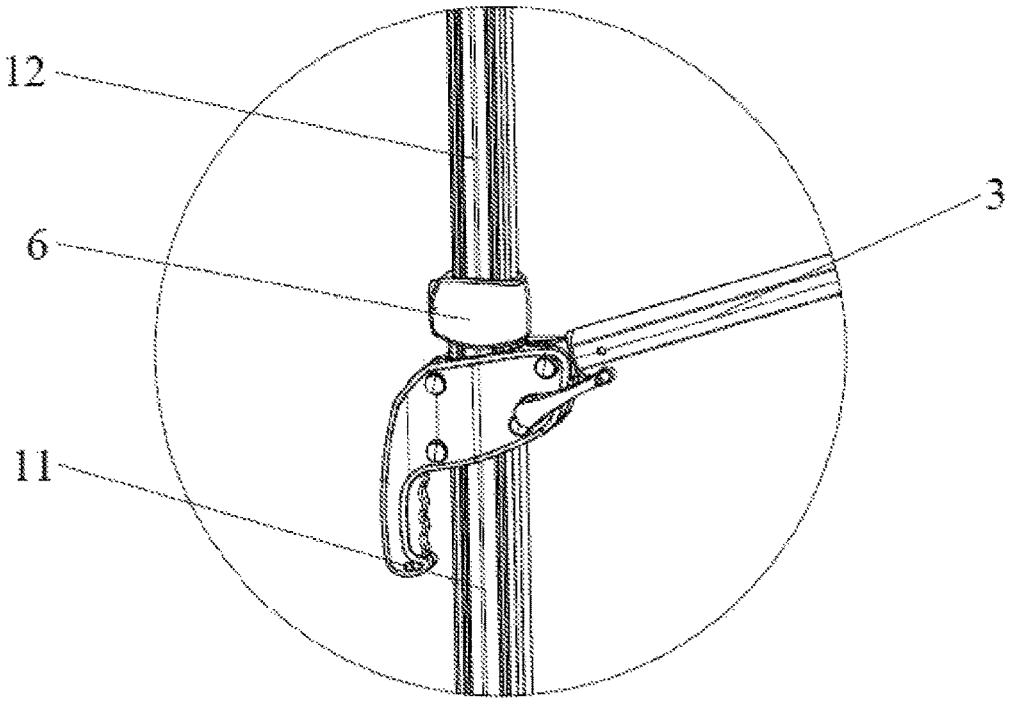
FIG. 2 is a structural schematic diagram of an extended state of an umbrella pole according to the disclosure.
Figure 3:
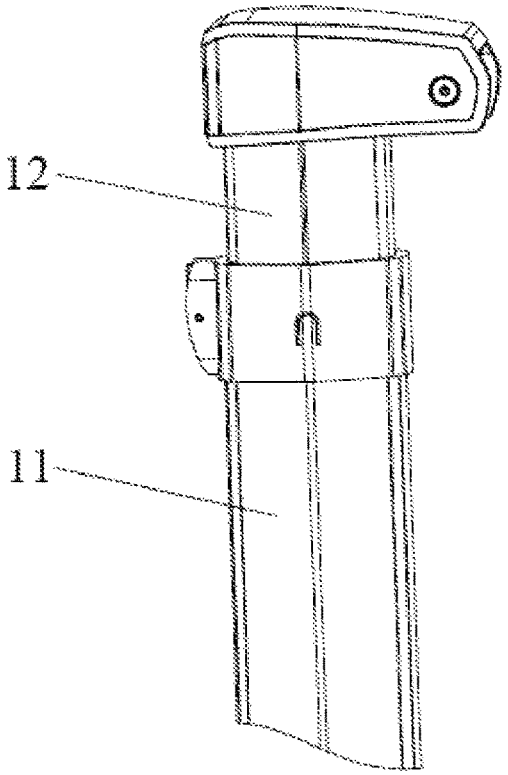
FIG. 3 is a structural schematic diagram of a retracted state of the umbrella pole according to the disclosure.
Figure 4:
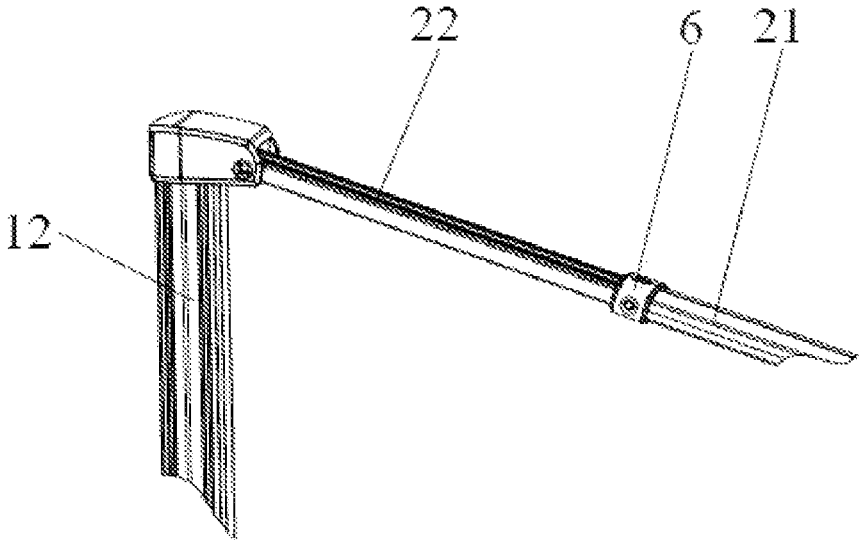
FIG. 4 is a structural schematic diagram of the extended state of a first pull rod according to the disclosure.
Figure 5:
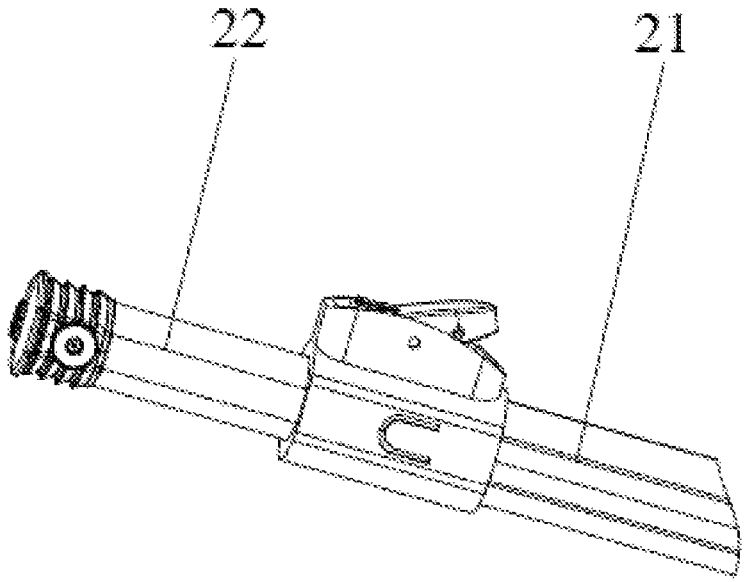
FIG. 5 is a structural schematic diagram of the retracted state of the first pull rod according to the disclosure.
Figure 6:
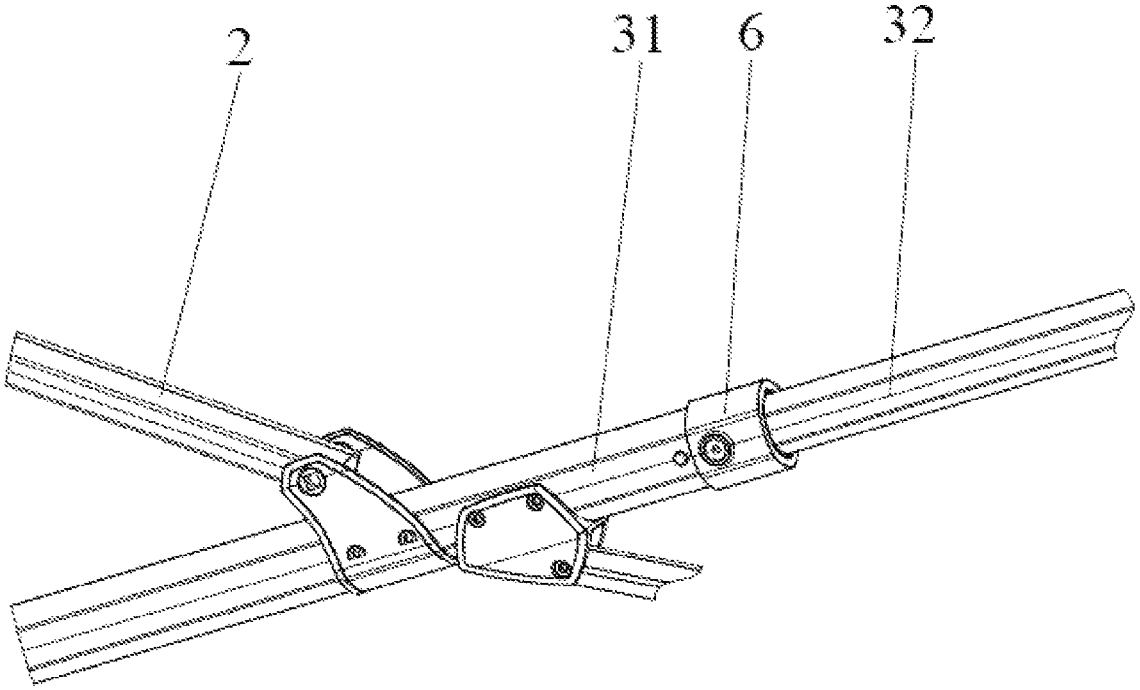
FIG. 6 is a structural schematic diagram of the extended state of a second pull rod according to the disclosure.
Figure 7:
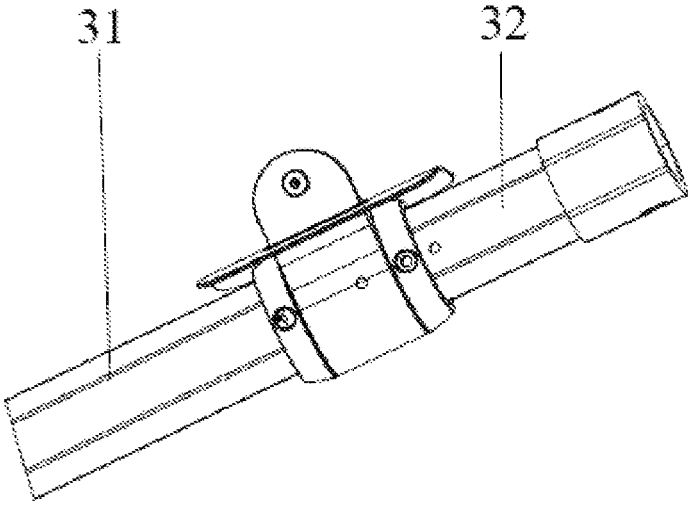
FIG. 7 is a structural schematic diagram of the retracted state of the second pull rod according to the disclosure.
Figure 8:
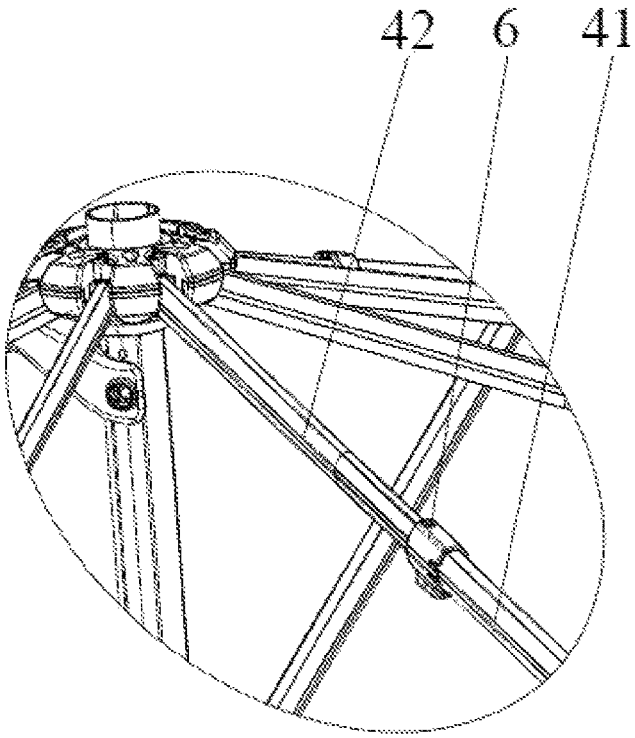
FIG. 8 is a structural schematic diagram of the extended state of a longer rib according to the disclosure.
Figure 9:
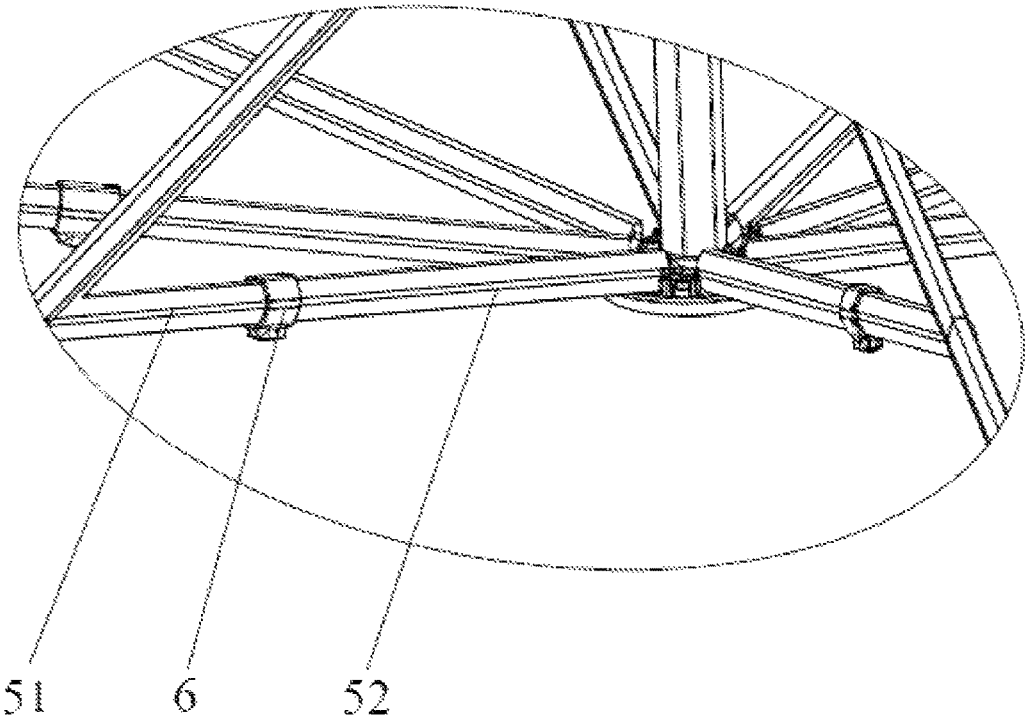
FIG. 9 is a structural schematic diagram of the extended state of a shorter rib according to the disclosure.
Figure 10:
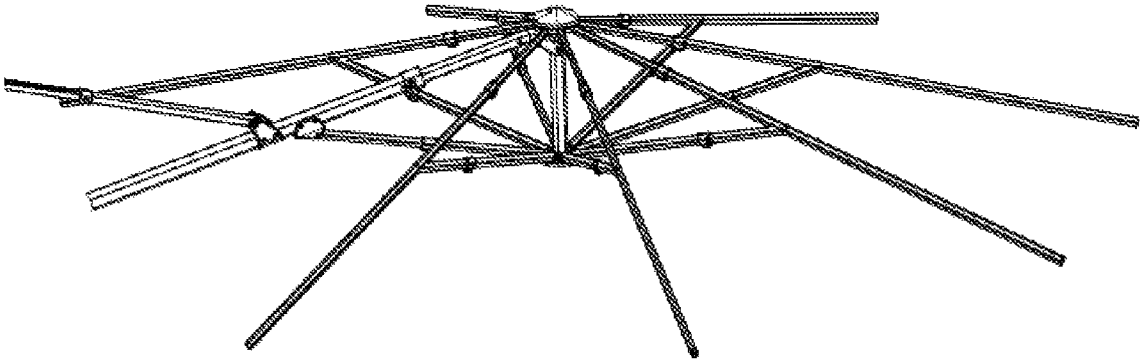
FIG. 10 is a structural schematic diagram of a rib assembly according to the disclosure.

In order to make the technical means, creative features, achievement goals and effects achieved by the disclosure easy to understand, the disclosure will be further described below in conjunction with specific illustrations.

As shown in FIG. 1 to FIG. 14, an outdoor umbrella frame having a telescopic structure provided by the disclosure includes an umbrella pole 1, a pull rod assembly and a rib assembly. The pull rod assembly includes a first pull rod 2 and a second pull rod 3. The rib assembly includes a longer rib 4 and a shorter rib 5. The umbrella pole 1 may be telescopic along a length direction, and one or more of the first pull rod 2, the second pull rod 3, the longer rib 4 and the shorter rib 5 may be telescopic along a length direction. When the outdoor umbrella frame needs to be assembled, the umbrella pole 1, the first pull rod 2, the second pull rod 3, the longer rib 4 and the shorter rib 5 are all in an extended and fixed state. When the outdoor umbrella frame needs to be disassembled for packing, any one or more of the umbrella pole 1, the first pull rod 2, the second pull rod 3, the longer rib 4 and the shorter rib 5 are in a retracted state.

Based on the above description, the outdoor umbrella frame preferably is a Roman umbrella frame, and may further be a banana umbrella frame, a push rod umbrella frame, etc.

In a preferred embodiment, the umbrella pole 1, the first pull rod 2, the second pull rod 3, the longer rib 4 and the shorter rib 5 all include a telescopic structure.

In a preferred embodiment, the umbrella pole 1, the first pull rod 2, the second pull rod 3 and the longer rib 4 include a telescopic structure, while the shorter rib 5 includes a single rib structure.

In a preferred embodiment, the umbrella pole 1, the second pull rod 3 and the longer rib 4 include a telescopic structure, the shorter rib 5 includes a single rib structure, and the first pull rod 2 includes a common pull rod structure.

In a preferred embodiment, the umbrella pole 1, the longer rib 4 and the shorter rib 5 include a telescopic structure, while the first pull rod 2 and the second pull rod 3 include a common pull rod structure.

In a preferred embodiment, the umbrella pole 1 and the longer rib 4 include a telescopic structure, while the first pull rod 2, the second pull rod 3 and the shorter rib 5 include a common pull rod structure.

In a preferred embodiment, the umbrella pole 1 includes at least two telescopic structures, preferably two telescopic structures, and may further be three or four telescopic structures. The umbrella pole 1 includes an umbrella pole body 11 and a telescopic umbrella pole 12, the telescopic umbrella pole 12 is located on an upper portion or/and a lower portion of the umbrella pole body 11, and the telescopic umbrella pole 12 and the umbrella pole body 11 may be in telescopic fit. The telescopic umbrella pole 12 is often smaller than the umbrella pole body 11 in size, and may be telescopically superimposed in a cavity of the umbrella pole body 11. The telescopic umbrella pole 12 includes at least one telescopic umbrella pole unit, may further be multiple telescopic umbrella pole units, and preferably is one telescopic umbrella pole unit. In an embodiment, the telescopic umbrella pole 12 is located on the upper portion of the umbrella pole body 11. In an embodiment, two telescopic umbrella poles 12 are provided, and are respectively located on the upper portion and the lower portion of the umbrella pole body 11.

Any one or more of the first pull rod 2, the second pull rod 3, the longer rib 4 and the shorter rib 5 include at least two telescopic structures.

In a preferred embodiment, the first pull rod 2 includes at least two telescopic structures, preferably two telescopic structures, and may further be three or four telescopic structures. The first pull rod 2 includes a first pull rod body 21 and a first telescopic pull rod 22, one end of the first telescopic pull rod 22 is hinged to the telescopic umbrella pole 12, the other end of the first telescopic pull rod 22 is telescopically docked with one end of the first pull rod body 21, and the other end of the first pull rod body 21 is hinged to the second pull rod 3. The first telescopic pull rod 22 is often smaller than the first pull rod body 21 in size, and may be telescopically superimposed in a cavity of the first pull rod body 21. The first telescopic pull rod 22 includes at least one first telescopic pull rod unit, may further be multiple first telescopic pull rod units, and preferably is one first telescopic pull rod unit.

In a preferred embodiment, the second pull rod 3 includes at least two telescopic structures, preferably two telescopic structures, and may further be three or four telescopic structures. The second pull rod 3 includes a second pull rod body 31 and a second telescopic pull rod 32, one end of the second telescopic pull rod 32 is hinged to an upper umbrella tray, the other end of the second telescopic pull rod 32 is telescopically docked with one end of the second pull rod body 31, and the other end of the second pull rod body 31 is hinged to a handle housing. The second telescopic pull rod 32 is often smaller than the second pull rod body 31 in size, and may be telescopically superimposed in a cavity of the second pull rod body 31. The second telescopic pull rod 32 includes at least one second telescopic pull rod unit, may further be multiple second telescopic pull rod units, and preferably is one second telescopic pull rod unit.

In a preferred embodiment, the longer rib 4 includes at least two telescopic structures, preferably two telescopic structures, and may further be three or four telescopic structures. The longer rib 4 includes a longer rib body 41 and a longer telescopic rib 42, one end of the longer telescopic rib 42 is hinged to the upper umbrella tray, and the other end of the longer telescopic rib 42 is telescopically docked with the longer rib body 41. The longer telescopic rib 42 is often smaller than the longer rib body 41 in size, and may be telescopically superimposed in a cavity of the longer rib body 41. The longer telescopic rib 42 includes at least one longer telescopic rib unit, may further be multiple longer telescopic rib units, and preferably is one longer telescopic rib unit.

In a preferred embodiment, the shorter rib 5 includes at least two telescopic structures, preferably two telescopic structures, and may further be three or four telescopic structures. The shorter rib 5 includes a shorter rib body 51 and a shorter telescopic rib 52, one end of the shorter telescopic rib 52 is hinged to a lower umbrella tray, the other end of the shorter telescopic rib 52 is telescopically docked with the shorter rib body 51, and the other end of the shorter rib body 51 is hinged to the longer rib 4. The shorter telescopic rib 52 is often smaller than the shorter rib body 51 in size, and may be telescopically superimposed in a cavity of the shorter rib body 51. The shorter telescopic rib 52 includes at least one shorter telescopic rib unit, may further be multiple shorter telescopic rib units, and preferably is one shorter telescopic rib unit.

When any one of the umbrella pole 1, the first pull rod 2, the second pull rod 3, the longer rib 4 and the shorter rib 5 is extended or retracted along the length direction, extension or retraction locking may be implemented by a locking mechanism.

Figure 11:
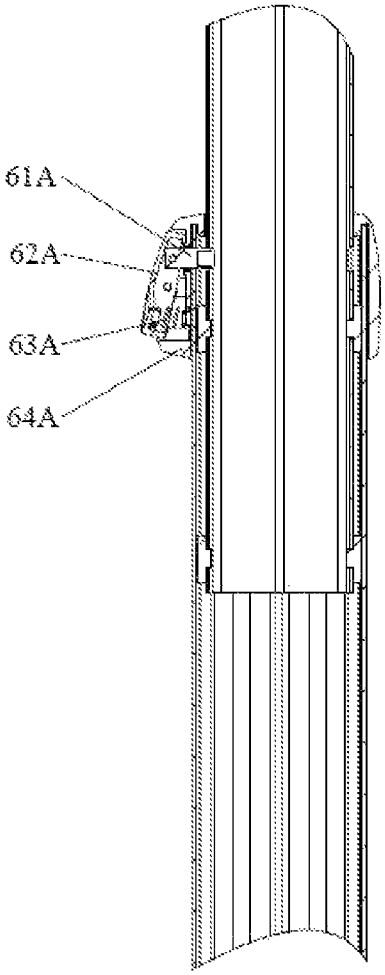
FIG. 11 is a first structural schematic diagram of a locking mechanism according to the disclosure.

Based on the above any embodiment, in a preferred embodiment, referring to FIG. 11, the locking mechanism 6 is configured as a lockpin locking mechanism. The lockpin mechanism 6 generally includes a lockpin piece 61A, a lockpin button 62A, a reset spring 63A and a mounting seat 64A. The mounting seat 64A is sleeved to ends of the umbrella pole 1, the first pull rod 2, the second pull rod 3, the longer rib 4 and the shorter rib 5, and is configured to mount the lockpin piece 61A, the lockpin button 62A and the reset spring 63A. The lockpin button 62A is configured to drive the lockpin piece 61A to move, and may be reset by the reset spring 63A.

Figure 12:
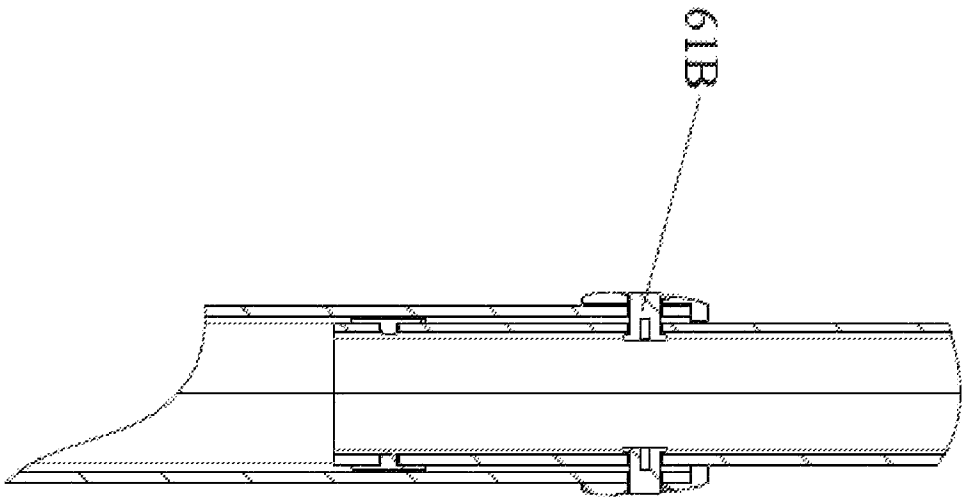
FIG. 12 is a second structural schematic diagram of a locking mechanism according to the disclosure.

Based on the above any embodiment, in a preferred embodiment, referring to FIG. 12, the locking mechanism 6 is configured as a spring button locking mechanism. A spring button piece 61B is disposed in a cavity of each of the umbrella pole 1, the first pull rod 2, the second pull rod 3, the longer rib 4 and the shorter rib 5.

Figure 13:
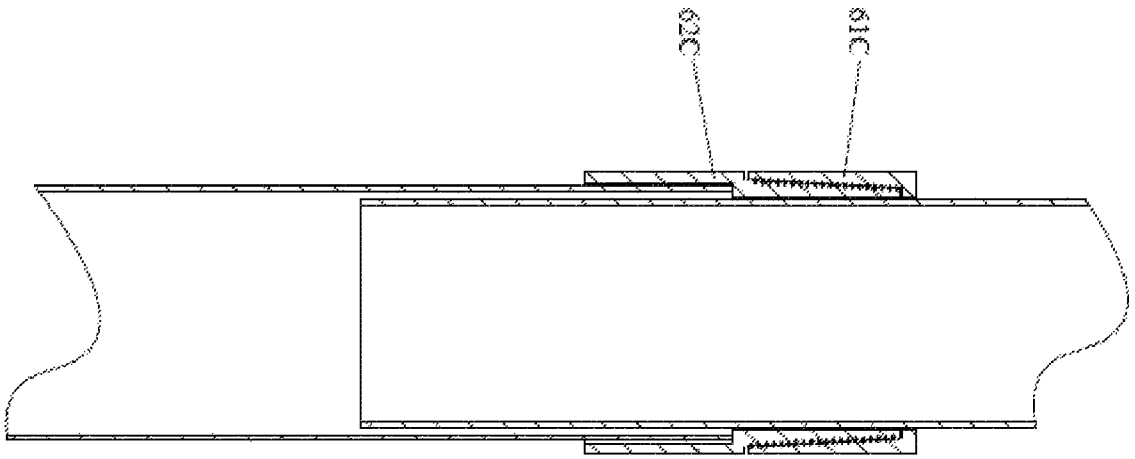
FIG. 13 is a third structural schematic diagram of a locking mechanism according to the disclosure.

Based on the above any embodiment, in a preferred embodiment, referring to FIG. 13, the locking mechanism 6 is configured as a screwed locking mechanism, and generally includes an upper thread bushing 61C and a lowerthread bushing 62C. After the upper thread bushing 61C and the lower thread bushing 62C are docked, they may be locked through rotation.

Figure 14:
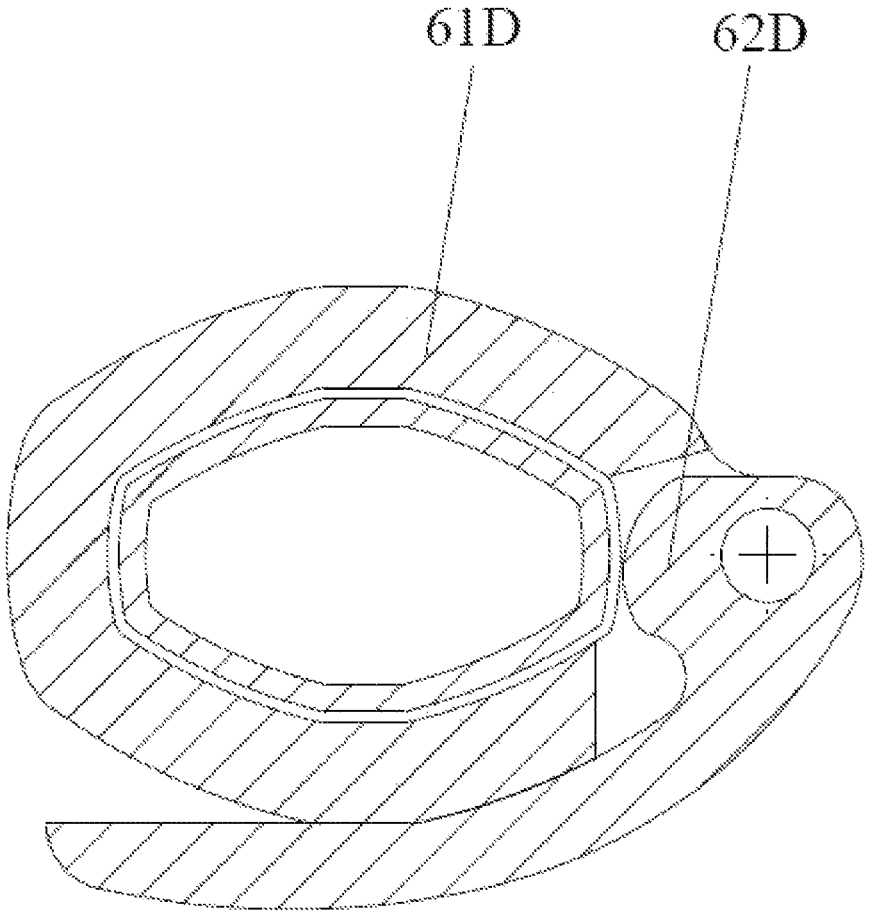
FIG. 14 is a fourth structural schematic diagram of a locking mechanism according to the disclosure.

Based on the above any embodiment, in a preferred embodiment, referring to FIG. 14, the locking mechanism 6 is configured as a handle rubbed locking mechanism, and generally includes a fixed seat 61D and a cam trigger 62D. A cam is disposed on the cam trigger 62D, and the locking is implemented by the use of squeezing and rubbing of the cam.

By means of an optimized design and with the utilization of telescopic and superimposed structures, the disclosure may implement the superimposition in size among the umbrella pole, the pull rod assembly and the rib assembly, thereby greatly reducing the overall size, reducing the packing size, and lowering the transportation cost.

During actual packing, for the same style of Roman umbrellas using the traditional umbrella frame and the telescopic umbrella frame, each single umbrella using the telescopic umbrella frame may be proportionally reduced by 30-45% in packing size.

As can be known from the technical knowledge, the disclosure may be implemented via other embodiments without departing from the spiritual essences or essential features. Therefore, the above-disclosed embodiments are merely illustrative and not exclusive in all respects. All changes which are within the scope of the disclosure or equivalent to the scope of the disclosure are encompassed by the disclosure.

What is claimed is:

1. An outdoor umbrella frame having a telescopic structure, the outdoor umbrella frame comprising an umbrella pole, a pull rod assembly and a rib assembly, wherein the pull rod assembly includes a first pull rod and a second pull rod, and the rib assembly includes a longer rib and a shorter rib, the umbrella pole is telescopic along a length direction, and one or more of the first pull rod, the second pull rod, the longer rib and the shorter rib are telescopic along a length direction; when the outdoor umbrella frame is assembled, the umbrella pole, the first pull rod, the second pull rod, the longer rib and the shorter rib are all in an extended and fixed state; and when the outdoor umbrella frame is disassembled for packing, any one or more of the umbrella pole, the first pull rod, the second pull rod, the longer rib and the shorter rib are in a retracted state, wherein the umbrella pole comprises an umbrella pole body and a telescopic umbrella pole, the telescopic umbrella pole is located on an upper portion or a lower portion of the umbrella pole body, and the telescopic umbrella pole and the umbrella pole body are in telescopic fit, the first pull rod comprises a first pull rod body and a first telescopic pull rod, one end of the first telescopic pull rod is hinged to the telescopic umbrella pole, the other end of the first telescopic pull rod is telescopically docked with one end of the first pull rod body, and the other end of the first pull rod body is hinged to the second pull rod.

2. The outdoor umbrella frame having the telescopic structure according to claim 1, wherein when any one of the umbrella pole, the first pull rod, the second pull rod, the longer rib and the shorter rib is extendable or retractable along the length direction, extension or retraction locking is implemented by a locking mechanism.

3. The outdoor umbrella frame having the telescopic structure according to claim 2, wherein the locking mechanism includes any one of a lockpin locking mechanism, a spring button locking mechanism, a screwed locking mechanism or a handle rubbed locking mechanism.

4. The outdoor umbrella frame having the telescopic structure according to claim 1, wherein the second pull rod comprises a second pull rod body and a second telescopic pull rod, one end of the second telescopic pull rod is hinged to an upper umbrella tray, the other end of the second telescopic pull rod is telescopically docked with one end of the second pull rod body, and the other end of the second pull rod body is hinged to a handle housing.

5. The outdoor umbrella frame having the telescopic structure according to claim 4, wherein the second telescopic pull rod comprises at least one second telescopic pull rod unit.

6. The outdoor umbrella frame having the telescopic structure according to claim 1, wherein the longer rib comprises a longer rib body and a longer telescopic rib, one end of the longer telescopic rib is hinged to an upper umbrella tray, and the other end of the longer telescopic rib is telescopically docked with the longer rib body.

7. The outdoor umbrella frame having the telescopic structure according to claim 6, wherein the longer telescopic rib comprises at least one longer telescopic rib unit.

8. The outdoor umbrella frame having the telescopic structure according to claim 1, wherein the shorter rib comprises a shorter rib body and a shorter telescopic rib, one end of the shorter telescopic rib is hinged to a lower umbrella tray, the other end of the shorter telescopic rib is telescopically docked with one end of the shorter rib body, and the other end of the shorter rib body is hinged to the longer ib.

9. The outdoor umbrella frame having the telescopic structure according to claim 8, wherein the shorter telescopic rib comprises at least one shorter telescopic rib unit.

10. The outdoor umbrella frame having the telescopic structure according to claim 1, wherein the telescopic umbrella pole comprises at least one telescopic umbrella pole unit.

11. The outdoor umbrella frame having the telescopic structure according to claim 1, wherein the first telescopic pull rod comprises at least one first telescopic pull rod unit.

* * * * *